US009961939B2

(12) United States Patent
Reevell

(10) Patent No.: US 9,961,939 B2
(45) Date of Patent: May 8, 2018

(54) ELECTRONIC CIGARETTE

(71) Applicant: NICOVENTURES HOLDINGS LIMITED, London (GB)

(72) Inventor: Tony Reevell, London (GB)

(73) Assignee: NICOVENTURES HOLDINGS LIMITED, London (GB)

( * ) Notice: Subject to any disclaimer, the term of this patent is extended or adjusted under 35 U.S.C. 154(b) by 83 days.

(21) Appl. No.: 14/888,514

(22) PCT Filed: Apr. 30, 2014

(86) PCT No.: PCT/GB2014/051334
§ 371 (c)(1),
(2) Date: Nov. 2, 2015

(87) PCT Pub. No.: WO2014/177861
PCT Pub. Date: Nov. 6, 2014

(65) Prior Publication Data

US 2016/0073693 A1 Mar. 17, 2016

(30) Foreign Application Priority Data

May 2, 2013 (GB) ..... 1307962.9

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01)

(58) Field of Classification Search
CPC ..... A24F 47/008; A61L 9/037; A61L 9/127
See application file for complete search history.

(56) References Cited

U.S. PATENT DOCUMENTS 228,598 A 6/1880 Buckley
353,327 A 11/1886 Randolph
(Continued)

FOREIGN PATENT DOCUMENTS

AT 507 187 B1 3/2010
AT 508244 12/2010
(Continued)

OTHER PUBLICATIONS

International Search Report and Written Opinion, International Application No. PCT/GB2014/051334, dated Jul. 21, 2014, 9 pages.
(Continued)

*Primary Examiner* — Eric Yaary
(74) *Attorney, Agent, or Firm* — Patterson Thuente Pedersen, P.A.

(57) ABSTRACT

An electronic cigarette has a vaporizer to produce vapor to be delivered to its mouth end. The vaporizer includes a tube having inlet and outlet ends. A porous matrix containing a vaporizable liquid, extends around the tube. Wicking fibers extend through side openings in the tube and are configured to wick the vaporizable liquid from the porous matrix into the tube, and electrical heater coil is powered by a battery to vaporize liquid on the wicking fibers in the tube, so that vapor is supplied along the tube end when the user draws on mouth end. The wicking diverge from the openings into fan shaped spread regions around outer surface of the tube so as to contact and receive the vaporizable liquid by capillary action from the matrix.

21 Claims, 5 Drawing Sheets

(56) References Cited

U.S. PATENT DOCUMENTS 576,653 A 2/1897 Bowlby
595,070 A 12/1897 Oldenbusch
744,074 A 11/1903 Hiering
799,844 A 9/1905 Fuller
885,374 A 4/1908 Pohlig
1,163,183 A 12/1915 Stoll
D53,386 S 5/1919 Thomas
1,436,157 A 11/1922 Fazio
1,807,936 A 6/1931 Saunders
1,815,069 A 7/1931 Petro
1,937,120 A 11/1933 Lagerholm
1,937,987 A 12/1933 Sexton
2,057,353 A 10/1936 Whittemore, Jr.
2,262,318 A 11/1941 Fox
2,411,946 A 12/1946 Vogel
2,467,923 A 4/1949 Allen
2,483,304 A 9/1949 Vogel
2,522,952 A 9/1950 Krohn
2,658,368 A 11/1953 Siegal
2,782,910 A 2/1957 Liebow
2,809,634 A 10/1957 Murai
3,111,396 A 11/1963 Ball
3,165,225 A 1/1965 Reitzel
3,402,724 A 9/1968 Blount
3,431,393 A 3/1969 Katsuda
3,433,632 A 3/1969 Elbert et al.
3,521,643 A 7/1970 Toth
3,722,742 A 3/1973 Wertz
3,743,136 A 7/1973 Chambers
3,804,100 A 4/1974 Fariello
3,861,523 A 1/1975 Fountain et al.
3,863,803 A 2/1975 Valcic
4,009,713 A 3/1977 Simmons et al.
4,031,906 A 6/1977 Knapp
4,094,119 A 6/1978 Sullivan
4,145,001 A 3/1979 Weyenberg et al.
4,161,283 A 7/1979 Hyman
4,190,412 A 2/1980 Tokai
4,193,513 A 3/1980 Bull
4,214,658 A 7/1980 Crow
4,503,851 A 3/1985 Braqunroth et al.
D279,508 S 7/1985 Bauer et al.
4,588,976 A 5/1986 Jaselli
4,676,237 A 6/1987 Wood et al.
4,733,794 A 3/1988 Kent
4,735,217 A 4/1988 Gerth et al.
4,753,383 A 6/1988 Focke et al.
4,793,478 A 12/1988 Tudor
4,848,374 A 7/1989 Chard et al.
4,917,301 A 4/1990 Munteanu
4,922,901 A 5/1990 Brooks et al.
4,923,059 A 5/1990 Evers et al.
4,947,874 A 8/1990 Brooks et al.
4,947,875 A 8/1990 Brooks et al.
4,978,814 A 12/1990 Honour
5,044,550 A 9/1991 Lamm
5,060,671 A 10/1991 Counts et al.
D322,687 S 12/1991 Tschudin
5,095,921 A 3/1992 Losee et al.
5,121,881 A 6/1992 Lembeck
5,167,242 A 12/1992 Turner et al.
5,179,966 A 1/1993 Losee et al.
5,247,947 A 9/1993 Clearman et al.
D346,878 S 5/1994 Gee et al.
5,322,075 A 6/1994 Deevi et al.
5,388,574 A 2/1995 Ingebrethsen
5,448,317 A 9/1995 Huang
5,497,792 A 3/1996 Prasad et al.
5,501,236 A 3/1996 Hill et al.
5,505,214 A 4/1996 Collins et al.
5,540,241 A 7/1996 Kim
5,636,787 A 6/1997 Gowhari
5,649,554 A 7/1997 Sprinkel et al.
5,666,977 A 9/1997 Higgins et al.
D392,069 S 3/1998 Rowland
D404,201 S 1/1999 Wennerstrom
5,865,185 A 2/1999 Collins et al.
5,896,984 A 4/1999 Focke
D414,892 S 10/1999 Chen
5,967,312 A 10/1999 Jacobs
6,065,592 A 5/2000 Wik
D432,263 S 10/2000 Issa
D434,217 S 11/2000 Packard et al.
D434,979 S 12/2000 Liu
6,155,268 A 12/2000 Takeuchi
D436,725 S 1/2001 Rogers
D438,003 S 2/2001 Minagawa et al.
D441,133 S 4/2001 Emery
6,275,650 B1 8/2001 Lambert
D449,521 S 10/2001 Pinkus et al.
6,321,757 B1 11/2001 McCutcheon
6,446,793 B1 9/2002 Layshock
D466,012 S 11/2002 Baker
D470,765 S 2/2003 Baker
D471,804 S 3/2003 Staples
D472,012 S 3/2003 South
6,527,166 B1 3/2003 Focke et al.
6,530,495 B1 3/2003 Joseph
6,561,391 B1 5/2003 Baker
6,652,804 B1 11/2003 Neumann et al.
6,715,605 B1 4/2004 Manservigi et al.
D493,617 S 8/2004 Armato
D509,732 S 9/2005 Staples
7,100,618 B2 9/2006 Dominguez
7,112,712 B1 9/2006 Ancell
D545,186 S 6/2007 Liebe et al.
D549,573 S 8/2007 Liebe et al.
7,263,282 B2 8/2007 Meyer
D550,455 S 9/2007 Barnhart
D566,329 S 4/2008 Bagaric et al.
D566,890 S 4/2008 Bagaric et al.
7,389,878 B1 6/2008 Torrico
D573,889 S 7/2008 Short et al.
7,400,940 B2 7/2008 McRae et al.
D575,451 S 8/2008 Jones et al.
7,455,176 B2 11/2008 Focke et al.
7,540,286 B2 6/2009 Cross et al.
7,565,969 B2 7/2009 He
D606,854 S 12/2009 Greenhalgh
D610,983 S 3/2010 Wai et al.
D611,806 S 3/2010 Bried
D613,903 S 4/2010 Wu
D613,904 S 4/2010 Wu
D616,753 S 6/2010 Beam et al.
7,832,410 B2 11/2010 Hon
D628,469 S 12/2010 Taylor et al.
D631,838 S 2/2011 Cheng
D636,257 S 4/2011 Bougoulas et al.
D649,658 S 11/2011 Belfrance et al.
D650,738 S 12/2011 Leung
8,113,343 B2 2/2012 Akerlind
D656,094 S 3/2012 Wu
8,156,944 B2 4/2012 Hon
D661,016 S 5/2012 Borges et al.
D671,677 S 11/2012 Wu
D671,678 S 11/2012 Wu
8,307,834 B1 11/2012 Palmerino, Sr. et al.
D672,642 S 12/2012 Supranowicz
D674,539 S 1/2013 Wu
8,365,742 B2 2/2013 Hon
8,375,957 B2 2/2013 Hon
8,393,331 B2 3/2013 Hon
8,448,783 B2 5/2013 Vecchi
8,490,628 B2 7/2013 Hon
8,511,318 B2 8/2013 Hon
D693,055 S 10/2013 Manca et al.
D700,397 S 2/2014 Manca et al.
8,752,545 B2 6/2014 Buchberger
8,689,805 B2 8/2014 Hon
8,794,245 B1 8/2014 Scatterday
8,833,364 B2 9/2014 Buchberger
D715,760 S 10/2014 Kim et al.
D716,267 S 10/2014 Kim et al.
D720,884 S 1/2015 Liu

(56) References Cited

U.S. PATENT DOCUMENTS

| | | | |
|---|---|---|---|
| 8,948,578 | B2 | 2/2015 | Buchberger |
| D723,738 | S | 3/2015 | Liu |
| D736,460 | S | 8/2015 | McKeon et al. |
| D737,507 | S | 8/2015 | Liu |
| 9,623,205 | B2 | 4/2017 | Buchberger |
| 2002/0079309 | A1 | 6/2002 | Cox et al. |
| 2003/0049025 | A1 | 3/2003 | Neumann et al. |
| 2003/0106552 | A1 | 6/2003 | Sprinkel, Jr. et al. |
| 2003/0200964 | A1 | 10/2003 | Blakley et al. |
| 2004/0056651 | A1 | 3/2004 | Marietta Bersana |
| 2004/0129793 | A1 | 7/2004 | Nguyen et al. |
| 2005/0087460 | A1 | 4/2005 | Bruhn et al. |
| 2005/0211243 | A1 | 9/2005 | Esser |
| 2005/0224375 | A1 | 10/2005 | Focke et al. |
| 2005/0268911 | A1 | 12/2005 | Cross et al. |
| 2007/0102013 | A1 | 5/2007 | Adams et al. |
| 2007/0107879 | A1 | 5/2007 | Radomski et al. |
| 2007/0155255 | A1 | 7/2007 | Galauner et al. |
| 2007/0193895 | A1 | 8/2007 | Weiss et al. |
| 2008/0017204 | A1 | 1/2008 | Braunshteyn |
| 2008/0092912 | A1 | 4/2008 | Robinson et al. |
| 2008/0223382 | A1 | 9/2008 | Zeanah |
| 2009/0095311 | A1 | 4/2009 | Han |
| 2009/0188490 | A1 | 7/2009 | Han |
| 2009/0266837 | A1 | 10/2009 | Gelardi et al. |
| 2009/0272379 | A1 | 11/2009 | Thorens et al. |
| 2009/0288966 | A1 | 11/2009 | Minarelli et al. |
| 2009/0293892 | A1 | 12/2009 | Williams |
| 2010/0236546 | A1 | 9/2010 | Yamada |
| 2010/0313901 | A1 | 12/2010 | Fernando et al. |
| 2011/0011396 | A1 | 1/2011 | Fang |
| 2011/0036363 | A1 | 2/2011 | Urtsev et al. |
| 2011/0126848 | A1 | 6/2011 | Zuber et al. |
| 2011/0180433 | A1 | 7/2011 | Rennecamp |
| 2011/0226236 | A1 | 9/2011 | Buchberger |
| 2011/0290267 | A1 | 12/2011 | Yamada et al. |
| 2011/0297166 | A1 | 12/2011 | Takeuchi et al. |
| 2011/0303231 | A1 | 12/2011 | Li et al. |
| 2012/0145169 | A1 | 6/2012 | Wu |
| 2012/0199146 | A1 | 8/2012 | Marangos |
| 2012/0227752 | A1 | 9/2012 | Alelov |
| 2012/0227753 | A1 | 9/2012 | Newton |
| 2012/0260927 | A1 | 10/2012 | Liu |
| 2012/0285476 | A1 | 11/2012 | Hon |
| 2013/0074857 | A1 | 3/2013 | Buchberger |
| 2013/0081623 | A1 | 4/2013 | Buchberger |
| 2013/0098786 | A1 | 4/2013 | Collins |
| 2013/0192615 | A1 | 8/2013 | Tucker et al. |
| 2013/0192621 | A1 | 8/2013 | Li |
| 2013/0192623 | A1 | 8/2013 | Tucker |
| 2013/0213419 | A1* | 8/2013 | Tucker ..... A24F 47/008 131/328 |
| 2013/0284192 | A1 | 10/2013 | Peleg et al. |
| 2013/0333700 | A1 | 12/2013 | Buchberger |
| 2013/0340779 | A1 | 12/2013 | Liu |
| 2013/0341218 | A1 | 12/2013 | Liu |
| 2013/0342157 | A1 | 12/2013 | Liu |
| 2014/0000638 | A1 | 1/2014 | Sebastian et al. |
| 2014/0007892 | A1 | 1/2014 | Liu |
| 2014/0020697 | A1 | 1/2014 | Liu |
| 2014/0048086 | A1 | 2/2014 | Zhanghua |
| 2014/0060528 | A1 | 3/2014 | Liu et al. |
| 2014/0060554 | A1 | 3/2014 | Collett et al. |
| 2014/0060555 | A1 | 3/2014 | Chang et al. |
| 2014/0196717 | A1 | 7/2014 | Liu |
| 2014/0196731 | A1 | 7/2014 | Scatterday |
| 2014/0202454 | A1 | 7/2014 | Buchberger |
| 2014/0209105 | A1* | 7/2014 | Sears ..... F22B 1/28 131/328 |
| 2014/0238396 | A1 | 8/2014 | Buchberger |
| 2014/0238423 | A1 | 8/2014 | Tucker et al. |
| 2014/0238424 | A1 | 8/2014 | Macko et al. |
| 2014/0261490 | A1 | 9/2014 | Kane |
| 2014/0261495 | A1 | 9/2014 | Novak |
| 2014/0270730 | A1 | 9/2014 | Depiano et al. |
| 2014/0283825 | A1 | 9/2014 | Buchberger |
| 2014/0286630 | A1 | 9/2014 | Buchberger |
| 2014/0299125 | A1 | 10/2014 | Buchberger |
| 2015/0114411 | A1 | 4/2015 | Buchberger |
| 2015/0208728 | A1 | 7/2015 | Lord |
| 2016/0073693 | A1 | 3/2016 | Reevell |
| 2016/0101909 | A1 | 4/2016 | Schennum et al. |
| 2016/0106154 | A1 | 4/2016 | Lord |
| 2016/0106155 | A1 | 4/2016 | Reevell |
| 2016/0120218 | A1 | 5/2016 | Schennum et al. |
| 2017/0042245 | A1 | 2/2017 | Buchberger |
| 2017/0188629 | A1 | 7/2017 | Dickens et al. |
| 2017/0197043 | A1 | 7/2017 | Buchberger |
| 2017/0197044 | A1 | 7/2017 | Buchberger |
| 2017/0197046 | A1 | 7/2017 | Buchberger |

FOREIGN PATENT DOCUMENTS

| | | | |
|---|---|---|---|
| AT | 510 405 | A4 | 4/2012 |
| AU | 63931/73 | | 6/1975 |
| BR | 6402132 | | 7/1986 |
| CA | 2309376 | | 11/2000 |
| CH | 698603 | | 9/2009 |
| CN | 1312730 | A | 12/2001 |
| CN | 1329567 | A | 1/2002 |
| CN | 2485265 | | 4/2002 |
| CN | 2660914 | | 12/2004 |
| CN | 1703279 | A | 11/2005 |
| CN | 2904674 | | 5/2007 |
| CN | 101115901 | A | 1/2008 |
| CN | 201023852 | | 2/2008 |
| CN | 201238609 | | 5/2009 |
| CN | 201240612 | Y | 5/2009 |
| CN | 201375023 | | 1/2010 |
| CN | 201430913 | Y | 3/2010 |
| CN | 201592850 | | 9/2010 |
| CN | 101878958 | | 11/2010 |
| CN | 201657770 | U | 12/2010 |
| CN | 102014677 | A | 4/2011 |
| CN | 201830900 | U | 5/2011 |
| CN | 201860753 | U | 6/2011 |
| CN | 102264420 | A | 11/2011 |
| CN | 202122096 | | 1/2012 |
| CN | 202172846 | | 3/2012 |
| CN | 102655773 | A | 9/2012 |
| CN | 202 722 498 | U | 2/2013 |
| CN | 202 750 708 | U | 2/2013 |
| CN | 202722498 | | 2/2013 |
| DE | 594585 | | 3/1934 |
| DE | 1950439 | | 4/1971 |
| DE | 2940797 | | 4/1981 |
| DE | 3148335 | | 7/1983 |
| DE | 3218760 | | 12/1983 |
| DE | 3936687 | | 5/1990 |
| DE | 19630619 | | 2/1998 |
| DE | 19654945 | | 3/1998 |
| DE | 10330681 | | 6/2004 |
| DE | 202006013439 | | 10/2006 |
| DE | 202013100606 | U1 | 2/2013 |
| EP | 0845220 | | 6/1998 |
| EP | 0893071 | | 1/1999 |
| EP | 1166814 | | 1/2002 |
| EP | 1166847 | | 1/2002 |
| EP | 1736065 | | 12/2006 |
| EP | 1820748 | A1 | 8/2007 |
| EP | 1847671 | | 10/2007 |
| EP | 2018886 | | 1/2009 |
| EP | 2113178 | | 11/2009 |
| EP | 2340729 | | 7/2011 |
| EP | 2 698 070 | A1 | 2/2014 |
| EP | 2762019 | A1 | 8/2014 |
| EP | 2835062 | A1 | 2/2015 |
| FR | 472030 | | 11/1914 |
| FR | 960469 | | 4/1950 |
| FR | 1292446 | | 5/1962 |
| GB | 30472 | | 12/1909 |
| GB | 191100628 | | 11/1911 |
| GB | 25575 | | 3/1912 |
| GB | 191311086 | | 9/1913 |

(56) References Cited

FOREIGN PATENT DOCUMENTS

| | | | |
|---|---|---|---|
| GB | 110216 | | 10/1917 |
| GB | 111454 | | 11/1917 |
| GB | 120016 | | 10/1918 |
| GB | 160493 | | 3/1921 |
| GB | 163124 | | 5/1921 |
| GB | 215992 | | 5/1924 |
| GB | 268967 | | 4/1927 |
| GB | 402064 | | 11/1933 |
| GB | 507955 | | 6/1939 |
| GB | 544329 | | 4/1942 |
| GB | 565574 | | 11/1944 |
| GB | 611596 | | 11/1948 |
| GB | 626888 | | 7/1949 |
| GB | 871869 | | 7/1961 |
| GB | 1313525 | | 4/1973 |
| GB | 1046183 | | 7/1988 |
| GB | 2275464 | | 8/1994 |
| GB | 2068034 | | 11/1997 |
| GB | 2369108 | | 5/2002 |
| GB | 4000273 | | 12/2006 |
| GB | 4006615 | | 10/2008 |
| GB | 220229 | | 8/2014 |
| JP | S5289386 | A | 7/1977 |
| JP | 57S-140354 | U | 8/1982 |
| JP | 8299862 | | 11/1996 |
| JP | 11-503912 | | 4/1999 |
| JP | H1189551 | | 4/1999 |
| JP | 3093201 | U | 4/2003 |
| JP | 2004332069 | | 11/2004 |
| JP | 2005-013092 | | 1/2005 |
| JP | 2005-138773 | | 6/2005 |
| JP | 2007-297124 | | 11/2007 |
| JP | 2009-526714 | | 7/2009 |
| JP | 2011-087569 | | 5/2011 |
| NL | 6617184 | | 6/1967 |
| RU | 2311859 | C2 | 12/2007 |
| RU | 2360583 | C1 | 7/2009 |
| RU | 89927 | U1 | 12/2009 |
| RU | 94815 | | 6/2010 |
| RU | 103281 | U1 | 4/2011 |
| RU | 115629 | U1 | 5/2012 |
| RU | 121706 | | 11/2012 |
| RU | 122000 | U1 | 11/2012 |
| RU | 124120 | | 1/2013 |
| UA | 78167 | | 3/2013 |
| WO | WO9632854 | | 10/1996 |
| WO | WO0009188 | | 2/2000 |
| WO | WO0021598 | | 4/2000 |
| WO | WO2002060769 | | 8/2002 |
| WO | WO03028409 | | 4/2003 |
| WO | WO03050405 | | 6/2003 |
| WO | WO2003083283 | | 10/2003 |
| WO | WO2004022243 | | 3/2004 |
| WO | WO2005106350 | | 11/2005 |
| WO | WO2006082571 | | 8/2006 |
| WO | WO2007042941 | | 4/2007 |
| WO | WO2007131449 | | 11/2007 |
| WO | WO2008006048 | | 1/2008 |
| WO | WO2008104870 | | 9/2008 |
| WO | WO2009015410 | | 2/2009 |
| WO | WO2009/092419 | | 9/2009 |
| WO | WO 2009/132793 | | 11/2009 |
| WO | WO2010045670 | | 4/2010 |
| WO | WO2010045671 | | 4/2010 |
| WO | WO 2011/109849 | | 9/2011 |
| WO | WO2011137453 | A2 | 11/2011 |
| WO | WO2012025496 | | 3/2012 |
| WO | WO 2012/065310 | A1 | 5/2012 |
| WO | WO2012065754 | | 5/2012 |
| WO | WO2012114082 | | 8/2012 |
| WO | WO2013034453 | | 3/2013 |
| WO | WO2013034460 | | 3/2013 |
| WO | WO2013045942 | | 4/2013 |
| WO | WO2013057185 | | 4/2013 |
| WO | WO2013098395 | | 7/2013 |
| WO | WO 2013/116558 | | 8/2013 |
| WO | WO 2013/116558 | A1 | 8/2013 |
| WO | WO 2014/130695 | A1 | 8/2013 |
| WO | WO2013142671 | | 9/2013 |
| WO | WO2013189050 | | 12/2013 |
| WO | WO2013189052 | | 12/2013 |
| WO | WO2014005275 | | 1/2014 |
| WO | WO2014015463 | | 1/2014 |
| WO | WO2014140320 | | 9/2014 |
| WO | WO2014150131 | | 9/2014 |

OTHER PUBLICATIONS

Russian Office Action, Application No. 2015146847, dated Sep. 22, 2017, 11 pages.

Application and File History for U.S. Appl. No. 14/888,517, filed Nov. 2, 2015, inventor Reevell.

Application and File History for U.S. Appl. No. 14/787,946, filed Oct. 29, 2015, inventor Lord.

Application and File History for U.S. Appl. No. 14/235,210, filed Mar. 4, 2014, inventor Buchberger.

Application and File History for U.S. Appl. No. 14/353,256, filed Apr. 21, 2014, inventor Buchberger.

Application and File History for U.S. Appl. No. 14/594,065, filed Jan. 9, 2015, inventor Buchberger.

Application and File History for U.S. Appl. No. 15/454,156, filed Mar. 9, 2017, inventor Buchberger.

Application and File History for U.S. Appl. No. 15/307,095, filed Oct. 27, 2016, inventor Buchberger.

International Preliminary Report on Patentability for International Application No. PCT/GB2014/051688 dated Dec. 8, 2015.

International Search Report or International Application No. PCT/GB2014/051688 dated Aug. 26, 2014.

Written Opinion for International Application No. PCT/GB2014/051688 dated Aug. 26, 2014.

International Search Report of the International Searching Authority for International Application No. PCT/GB2014/051633 dated Dec. 4, 2014.

Written Opinion of the International Searching Authority for International Application No. PCT/GB2014/051633 dated Dec. 4, 2014.

Notification of Transmittal of IPRP for International Application No. PCT/GB2014/051633 dated Oct. 23, 2015.

International Preliminary Report on Patentability and Written Opinion dated Nov. 3, 2015 for International Application No. PCT/GB2014/051332.

International Search Report dated Jul. 21, 2014 for International Application No. PCT/GB2014/051332.

Office Action dated Sep. 3, 2014, for Russian Application No. 2013504605.

International Search Report dated Jan. 26, 2010 for International Application No. PCT/AT2009/000414, 5 pages (with translation).

International Preliminary Report on Patentability, dated Apr. 26, 2011, for International Application No. PCT/AT2009/000414, 7 pages.

Written Opinion, dated Jan. 26, 2010 , for International Application No. PCT/AT2009/000414, 14 pages (with translation).

International Search Report and Written Opinion for International Application No. PCT/AT2012/000017 dated Jul. 3, 2012.

International Preliminary Report on Patentability dated Aug. 13, 2013 for International Application No. PCT/AT2012/000017.

Japanese Notice of Reasons for Rejection for Japanese Application No. 2015-137361 dated May 31, 2016.

IPRP dated Apr. 22, 2014 for International Patent Application No. PCT/EP2012/070647 filed Oct. 18, 2012.

International Search Report and Written Opinion dated Feb. 6, 2013 for PCT/EP2012/070647 filed Oct. 18, 2012.

IPRP, International Application No. PCT/GB2014/051334 dated Nov. 12, 2015.

International Search Report and Written Opinion for International Application No. PCT/EP2012/003103 dated Nov. 26, 2012.

Kynol, Standard Specifications of Kynol Activated Carbon Fiber Products, published by Kynol, 2 pages, Date unknown.

(56) References Cited

OTHER PUBLICATIONS

European Search Report for European Application No. 15178588 dated Apr. 14, 2016.
Chinese Office Action for Chinese Application No. 201480024978.X dated Jan. 18, 2017.
Russian Search Report for Russian Application No. 2015146843/12 (072088) dated Apr. 24, 2017.
International Search Report and Written Opinion for International Application No. PCT/GB2014/051333 dated Jul. 17, 2014.
IPRP for International Application No. PCT/GB2014/051333 dated Aug. 5, 2015.
International Search Report for corresponding International Application No. PCT/GB2015/051213 dated Jul. 16, 2015; 5 pages.
Written Opinion of the International Searching Authority for corresponding International Application No. PCT/GB2015/051213 dated Jul. 16, 2015; 9 pages.
IPRP for corresponding International Application No. PCT/GB2015/051213 dated Jul. 14, 2016; 21 pages.
Translation of Search Report for JP2016517671 date of search Feb. 1, 2017.
Chinese Office Action for Chinese Application No. 201480031296.1 dated Mar. 27, 2017.
Chinese Notification of First Office Action for Chinese Application No. 2014800319265 dated Apr. 21, 2017.
Korean Office Action, Korean Application No. 10-2015-7034538, dated May 12, 2017, 5 pages.
Chinese Office Action for Chinese Application No. 201480024988.3 dated Dec. 30, 2016.
Chinese Office Action for Chinese Application No. 201480024988.3 dated Sep. 11, 2017.
Decision to Grant in Russian Application No. 120267, dated Oct. 26, 2016. No English translation available.
Great Britain Examination Report, Application No. GB1405720.2, dated Jun. 27, 2017, 3 pages.
GB Intention to Grant, Application No. GB1405720.2, dated Sep. 26, 2017, 2 pages.
Russian Decision to Grant, Application No. 2015146845, dated Apr. 27, 2017, 8 pages.

* cited by examiner

ELECTRONIC CIGARETTE

RELATED APPLICATIONS

The present application is a National Phase entry of PCT Application No. PCT/GB2014/051334, filed Apr. 30, 2014, which claims the benefit of GB Application No. 1307962.9, filed May 2, 2013, each of which is incorporated herein by reference in its entirety.

TECHNICAL FIELD

Embodiments relate to an electronic cigarette.

SUMMARY

Embodiments of electronic cigarette described herein comprise an electronic cigarette comprising a generally cylindrical housing with a proximal mouth end and a distal end, and within the housing: a vaporizer to produce vapor to be delivered to the mouth end, a battery, and sensor circuitry to detect a user drawing on the mouth end and connect the battery to power the vaporizer to produce vapor, the vaporizer comprising: a tube having inlet and outlet ends and extending longitudinally of the housing, supports at opposite ends of the tube for directing airflow into and out of the tube from the inlet to the outlet, a porous matrix containing a vaporizable liquid extending around the tube, wicking fibers extending through side openings in the tube and configured to wick the vaporizable liquid from the porous matrix into the tube, and an electrical heater coil in the tube configured to be powered by the battery to vaporize liquid on the wicking fibers in the tube, so that vapor is supplied along the tube to the outlet end when the user draws thereon, wherein the wicking fibers diverge from one another from the side openings and are spread over the outer surface of the tube so as to contact and receive the vaporizable liquid by capillary action from the matrix.

The spread fibers may lie spread over the outer surface of the tube in an arc which at its outermost spread subtends an angle at the central longitudinal axis of the tube of at least 30°, for example in the range 40°-150°.

The spread wicking fibers may extend towards the inlet end or the outlet end of the tube or both.

The supports for the tube may include a mouth end stopper that is push-fitted into the mouth end of the housing, which includes a mouthpiece spigot onto which the outlet end of the tube is received, and an outlet passageway extending through the spigot to provide an outlet for vapor from the tube.

Also, the supports for the tube may include an annular support member that includes a peripheral surface to engage with the interior of the housing, an inlet spigot on which the inlet end of the tube is mounted, and an inlet passageway extending through the inlet spigot to provide an inlet for air into the tube.

BRIEF DESCRIPTION OF THE DRAWINGS

Embodiments of electronic cigarette will now be described in more detail by way of example with reference to the accompanying drawings, in which.

DETAILED DESCRIPTION

Figure 1:
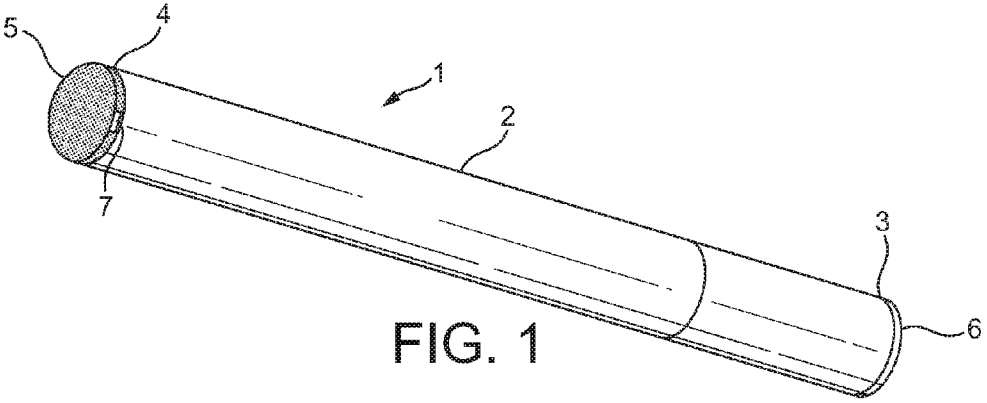
FIG. 1 is a schematic perspective view of an electronic cigarette.
Figure 2:
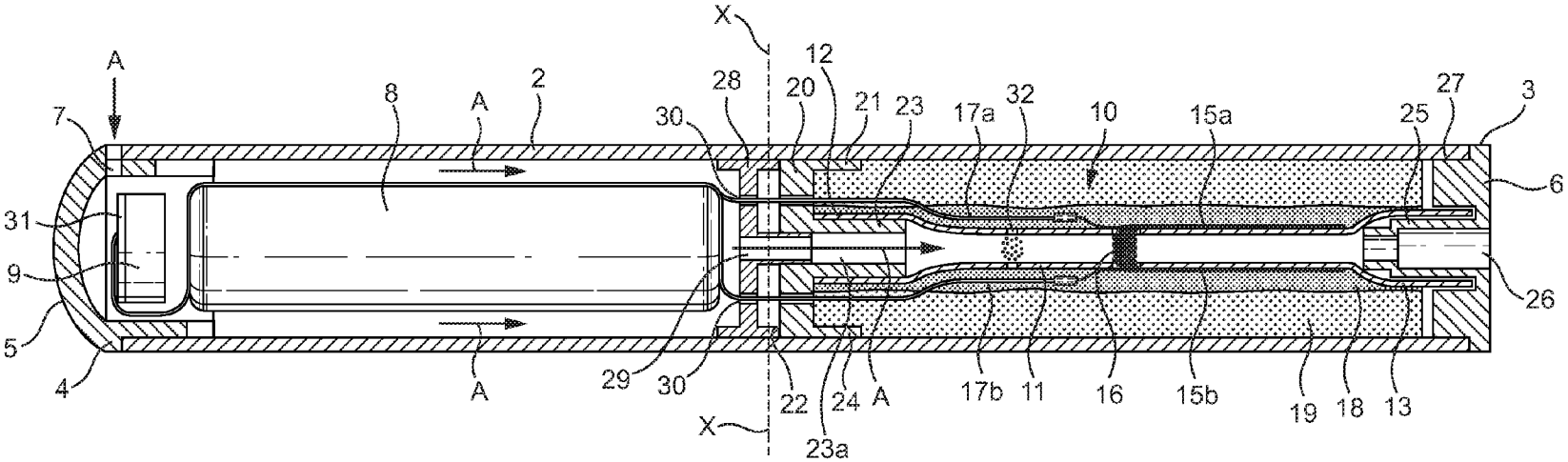
FIG. 2 is a longitudinal section through the electronic cigarette shown in FIG. 1.

Referring to FIGS. 1 and 2, an electronic cigarette 1 includes a generally cylindrical housing 2 conveniently in the form of a tube of plastics material that extends from a proximal or mouth end 3 to distal end 4. An end cap 5 of translucent plastics material is push-fitted into the distal end 4 and a mouth end stopper 6 is similarly fitted into the mouth end 3. The tube 2 is flexible and given rigidity in part by its internal components, as will be described in more detail hereinafter. The tube in one example is made of polypropylene.

As shown in FIG. 2, the end cap 5 includes an air inlet 7 so that when the user draws on the mouth end 3, air is drawn into the housing 2 and vapor is supplied to the user through the mouth end 3 as will be described hereinafter.

The housing 2 contains a battery 8, sensor circuitry 9 and a vaporizer 10 that produces a vapor to be supplied to the user.

Figure 3:
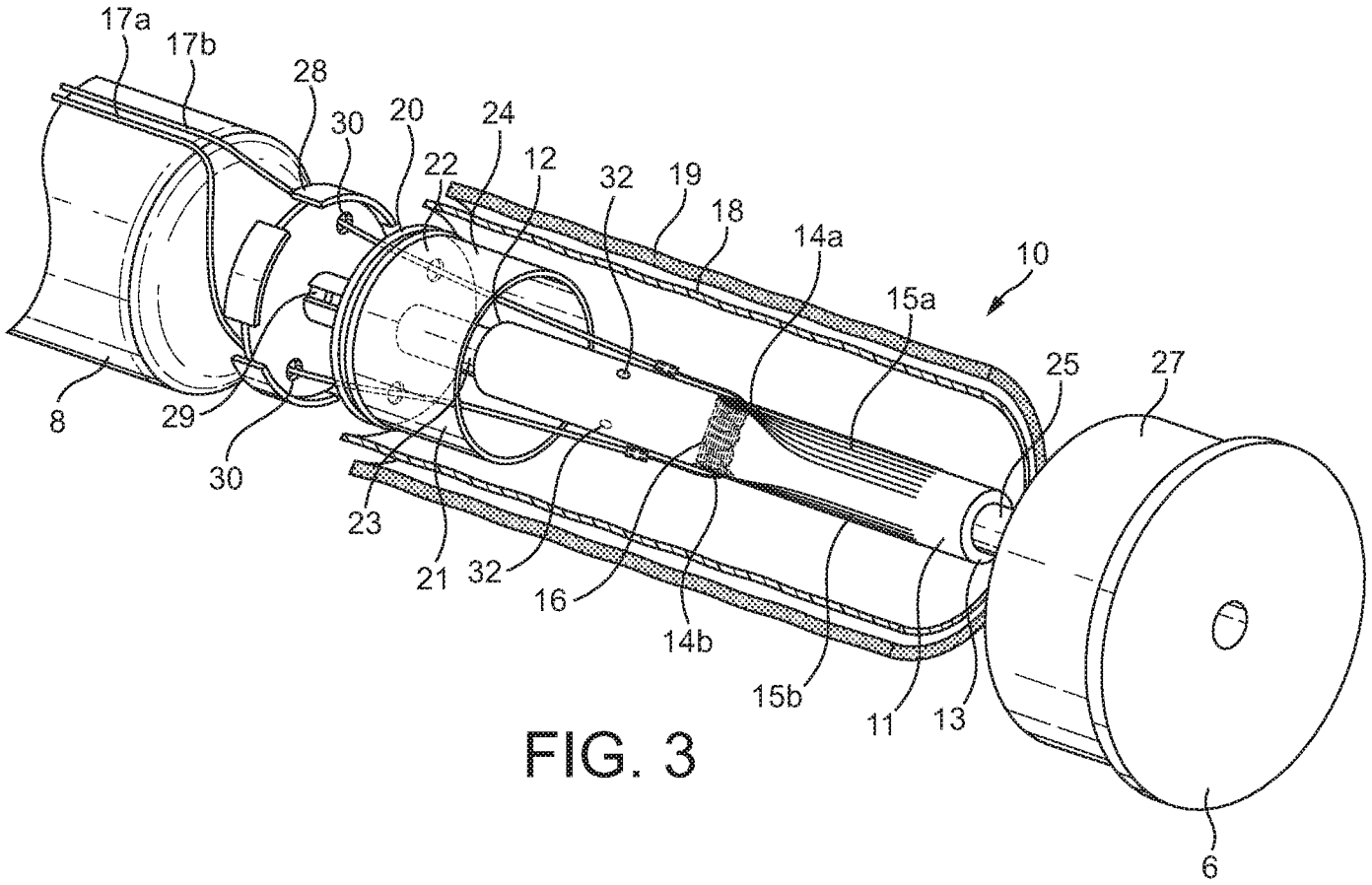
FIG. 3 is an exploded, partial perspective view of the vaporizer illustrated in FIG. 2, showing its heater element in a tube.
Figure 4:
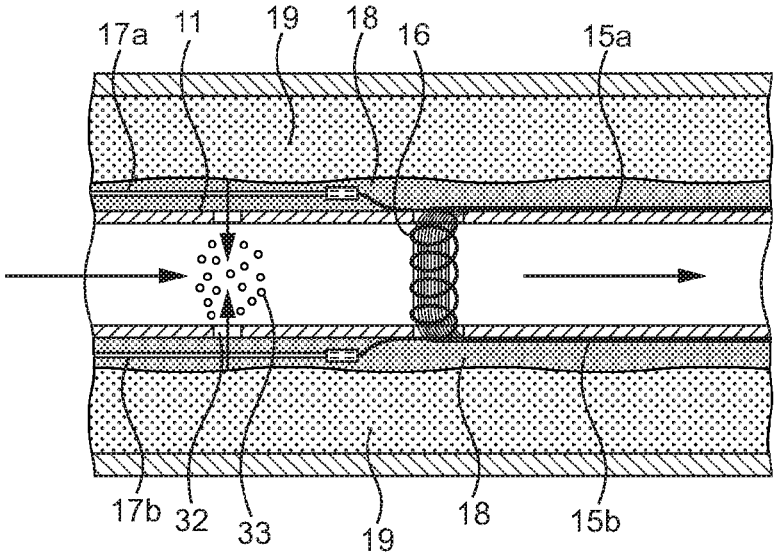
FIG. 4 is an enlarged portion of the sectional view shown in FIG. 2 in the region of its heater element.

The vaporizer 10 is illustrated in more detail in FIGS. 3 and 4. The vaporizer 10 includes a tube 11, conveniently made of fiberglass material which extends from an inlet end 12 to outlet end 13. The tube 11 includes diametrically opposed side openings 14*a,b*. Wicking fibers 15 extend through the side openings 14*a,b* across the interior of the tube. An electrical heater coil 16 extends diametrically across the tube 11, with the wicking fibers 15 passing axially within the coil 16. Electrical leads 17*a*, 17*b* supply electrical power to the coil 16 from the battery 8 under the control of the sensor circuitry 9 shown in FIG. 2.

The wicking fibers 15 conveniently comprises a bundle of fibers made of heat resistant material such as fiberglass, which are constrained in a generally cylindrical configuration where they extend diametrically across the tube 11 by the coil 16 and the side openings 14*a*, 14*b*. However, as shown schematically in FIG. 5A, the fibers 15 diverge from one another from the side openings 14*a*, 14*b* into generally fan shaped, spread regions 15*a*, 15*b* which lie on the curved outer surface 11*a* of the tube 11. In the example shown in FIGS. 2 and 3, the fan shaped, spread regions 15*a*, 15*b* both extend from the side openings 14*a*, 14*b* towards the outlet end 13 of tube 11.

Figure 5A:
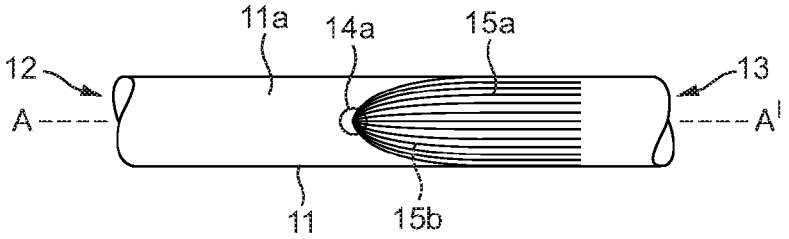
FIGS. 5A, 5B and 5C illustrate alternative spread arrangements for the wicking fibers on the tube's outer surface.
Figure 5B:
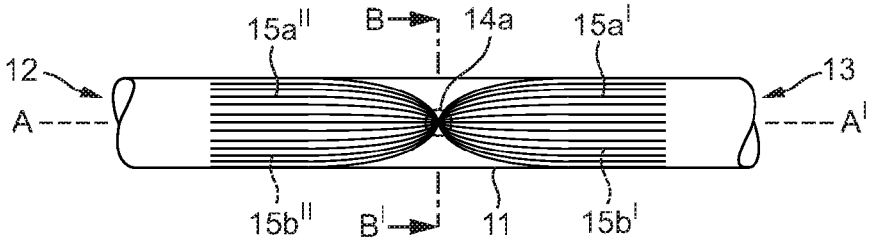
Figure 5C:
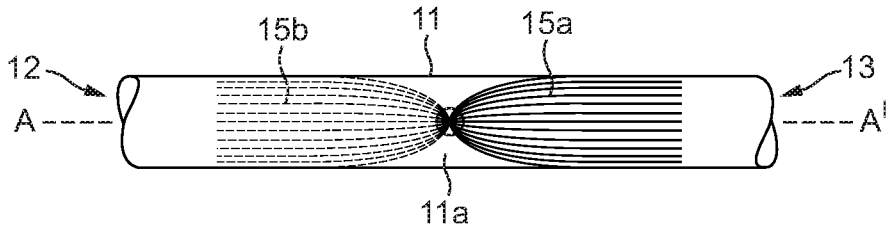

Alternative spread wicking fiber configurations are shown in FIGS. 5B and 5C.

In FIG. 5B, the fibers 15 emanating from side opening 14*a* are split into two bundles 15*a*' and 15*a*" which diverge from the opening 14*a* in opposite directions along the outer surface 11*a* of the tube 11. The fibers 15*b* emanating from opening 14*b* can be similarly split into two bundles 15*b*' and 15*b*" which diverge from the opening 14*b* in opposite directions along the outer surface 11*a* of the tube 11.

In FIG. 5C, the fibers 15*a* emanating from side opening 14*a* diverge from the side opening along the outer surface 11*a* of the tube 11 towards its outlet end 13. The fibers 15*b* emanating from opening 14*b* diverge from the opening 14*b* along the outer surface 11*a* of the tube 11 toward the inlet end 12.

It will be appreciated that various permutations of the various wicking fiber spreading arrangements shown in FIGS. 5A, 5B and 5C can used for the different fiber groupings. In the illustrations of FIGS. 5A, 5B and 5C the spread wicking fibers are all configured so as be spread symmetrically of the central longitudinal axis of symmetry A-A' of the tube 11 but it will be appreciated that asymmetrical wicking fiber configurations can also be used.

The spread configuration of the wicking fibers 15 over the outer surface 11*a* of the tube improves the operation of the vaporizer 10, as will be explained in more detail hereinafter.

A porous matrix that comprises first and second sheets of fibrous material 18, 19 is loaded with a vaporizable material, for example a nicotine and glycerol solution. The sheet 18 has a lower surface area and absorbency than the surrounding sheet 19 which can retain a larger volume of the liquid. Typically, the sheet 19 has a larger pore size than the sheet 18. The sheet 18 however facilitates transfer of the liquid t0 the wicking fibers 15 so that the liquid is wicked along the core of the heater coil 16.

One end of the vaporizer 10 includes an annular support member 20 that has a peripheral surface 21 that engages with the interior surface of the cylindrical housing 2. The annular support member 20 has a generally circular end face 22 extending diametrically across the housing 2 from which an axial inlet spigot 23 extends towards the mouth end 3 and receives the inlet end 12 of tube 11. The overlying ends of the sheets 18, 19 are retained between an annular, depending flange 24 and the inlet spigot 23 at the inlet end of tube 11, and generally fill the space between the interior surface of housing 2 and the tube 11. The annular support member 20 is conveniently flexible and made of silicon for example, so that it can be easily manipulated into housing 2 during manufacture. The sheets 18, 19 are wrapped around the tube 11 and thereby locate the wicking fibers 15 along the length of the outer surface of the tube 11. Spigot 23 includes a through hole to provide an air inlet passageway 23*a* into the tube 11.

The mouth end stopper 6 includes a mouthpiece spigot 25 that receives the outlet end 13 of tube 11. The end stopper 6 includes an axial outlet passageway 26 through the spigot to pass vapor to a user through the mouth end 3 of housing 2. Also, the mouth end stopper 6 includes a depending flange 27 so that the stopper 6 can be push-fitted into the mouth end 3 of housing 2. The outlet end 13 of tube 11 may extend slightly beyond the matrix 18, 19.

Thus there is a gap between the matrix and the mouth end 3 of the housing 2. Also, the mouthpiece spigot 25 which extends into the tube outlet end 13 is longer than the depending flange 27 that engages with the housing 2, so as to provide a gap between the porous matrix 18, 19 and the end stopper 6. This arrangement prevents or reduces leakage of the liquid held in the sheets 18, 19 through the mouth end 3 of the housing.

Thus, the annular support member 20 and the mouth end stopper 6 with their respective spigots 23, 25 cooperate with the tube 11 and the housing 2 to provide a closed plenum containing the porous sheets 18, 19 so as to retain the nicotine containing liquid in the sheets 18, 19 without leakage from the housing 2, and to allow the liquid to wick along wicking fibers 15 to be vaporized on operation of the heater coil 16.

An advantage of the spread configuration of fibers 15*a*, 15*b* around the outer surface 11*a* of tube 11 is that the area of contact between the sheet 18 of the porous matrix is maximized and extends around the circumference of the outer surface 11*a* of the tube 11, which improves the wicking effect performed by the fibers 15 and ensures that the liquid in the porous matrix 18, 19 is drained from around a major part of the circumferential extent of the tube 11, which assists in drawing substantially all of the liquid from the matrix by the wicking action for vaporization.

Figure 6:
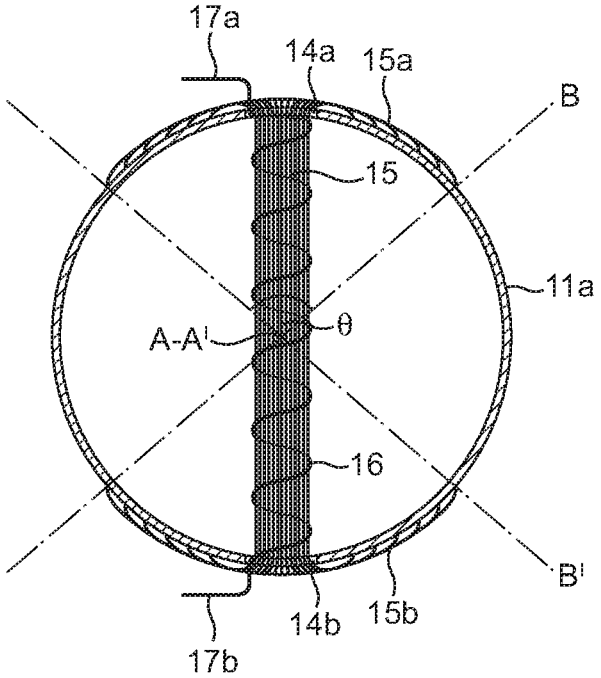
FIG. 6 is a cross sectional view of the tube and the heater element along the line B-B' of FIG. 5B, showing the angle subtended by the spread fibers at the central longitudinal axis of the tube.

Referring to FIG. 6, which shows a transverse section through the tube 11, the fibers 15 are shown threaded through the coil 16 and diverging into the generally fan shaped spread regions 15*a*, 15*b* around the outer surface 11*a* of the tube 11. The outermost or largest circumferential spread of the fan shaped spread wicking fiber region 15*a* subtends an angle θ with the central longitudinal axis A-A' of the tube 11 and improved wicking occurs when the maximum value of θ is at least 30°, i.e., the angle θ subtended by the widest part of the fan shaped region 15*a* $\theta \geq 30°$, such as $40° \leq \theta \leq 150°$. The fiber region 15*b* is similarly spread in FIG. 6 but a different value of θ could be used falling within the aforesaid range. Also the angle θ can be considered as the azimuth in polar coordinates from the axis A-A' such that the azimuth corresponding to the widest part of the fan shaped region falls within the aforesaid range.

A washer 28, conveniently made of rigid plastics material such as polypropylene, is provided between the vaporizer 10 and battery 8 to provide rigidity to the housing 2 in the region of the annular support member 20. The washer 28 includes an air passageway opening 29 and also openings 30 which receive the electrical leads 17*a*, 17*b*. The tubular housing 2 thus is relatively rigid to the touch of the user's fingers in the region of the battery 8 and the washer 28 but is more resilient to the touch in the region containing the vaporizer 10 to provide characteristics of tactility that are similar to those of a conventional tobacco containing cigarette.

An air passageway extends from the inlet opening 7 in the end cap 5 between the sensor circuitry 9 and battery 8 to the air passageway 29 in the washer 28 and thence to the inlet 12 of tube 11.

The sensor circuitry 9 may include a light source in the form of LED 31 which, when operated is visible through the translucent end cap 5.

When the user draws on the mouth end 3, air is drawn through the air inlet 7 in the direction of arrow A past the battery 8 and into the tube 11. The drawing action reduces the air pressure within the housing 2, which is sensed by the sensor circuitry 9. In response, electrical power from the battery 8 is switched by the sensor circuitry 9 to pass through leads 17*a*, 17*b* and energize heater coil 16. As a result, liquid which has been wicked by the wicking fibers 15 from the surrounding porous matrix layers 18, 19 is heated and thereby vaporized so that a stream of nicotine containing vapor is passed through the outlet passageway 26 for the user. Also, in response to the pressure reduction, the sensor circuitry illuminates the LED 31 to mimic the burning of a conventional tobacco containing cigarette.

Also, referring to FIGS. 3 and 4, atomization apertures 32 are formed in the tube 11 so that when the user draws on the mouth end 3, the resulting pressure reduction in tube 11 draws liquid from the surrounding porous matrix layers 18, 19 through the apertures 32 and as a result, the liquid is atomized, thereby producing an atomized stream 33 shown in FIG. 4. In this example, the atomization apertures 32 are provided between the inlet end 12 of tube 11 and the heater coil 16 so that the atomized droplets 33 then pass the heater 16, which encourages further vaporization of the atomized liquid.

Typically, the atomization apertures 32 are of a diameter between 0.1-0.5 mm. In the example of FIG. 3, the atomization apertures 32 are shown diametrically opposite one another but other configurations are possible, for example a distributed arrangement along the tube 11, which may be spatially uniform or otherwise. Also, one or more of apertures 32 may be provided downstream of the heater coil 16, towards the outlet end of the tube 11.

Figure 7:
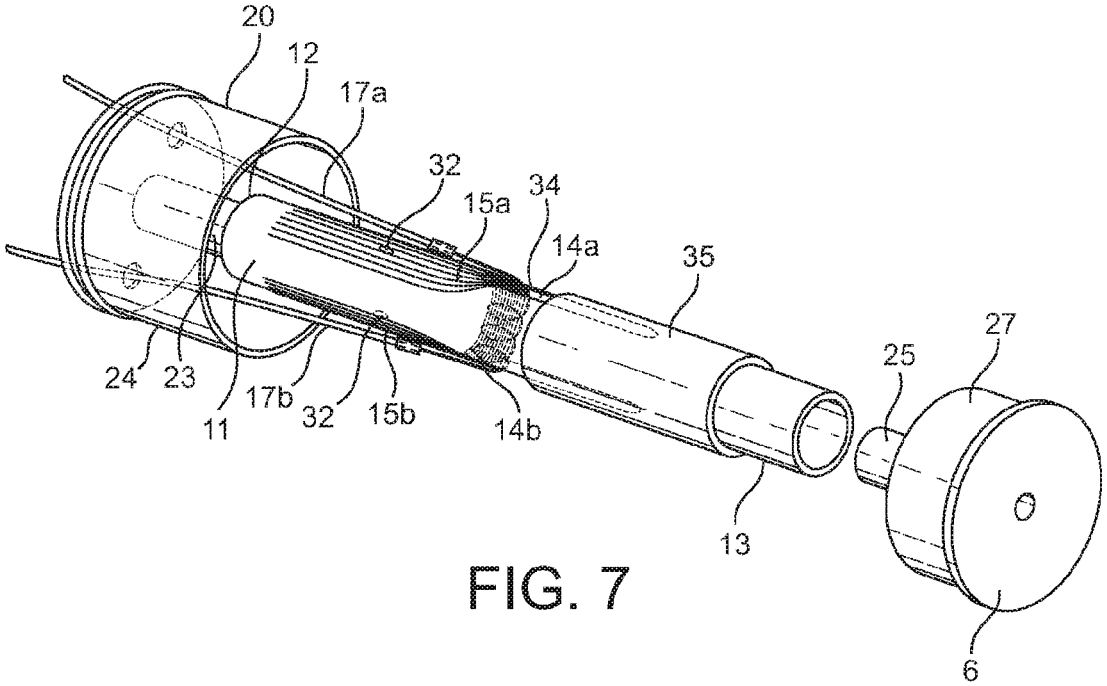
FIG. 7 is a schematic view of portions of an alternative embodiment of vaporizer.

A modified arrangement is illustrated in FIG. 7 with an alternative form of side openings to receive the wicking fibers 15. The coil 16 can be slid into an elongate slot 34 formed in tube 11 which is then closed by means of an overlying cylindrical sheath 35 that is conveniently is made of fiberglass material and slid into place from the outlet end 13 of tube 11. In this example, the spread wicking fibers 15 extend towards the inlet opening 12 of tube 11 rather than the outlet end 13, with the advantage that their ends can be sandwiched between the tube 11 and the porous matrix sheet, and held firmly between the region of the tube 11 on spigot 23 and the depending flange 24 of the annular support member 20.

In another modification, the device shown in FIGS. 1 and 2 may have a two part housing 2 so that the vaporizer 10 is attached to the battery 8 and sensor circuitry 9 by a releasable coupling (not shown) along hatched line X shown in FIG. 2.

In order to address various issues and advance the art, the entirety of this disclosure shows by way of illustration various embodiments in which that which is claimed may be practiced and provide for a superior electronic cigarette. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An electronic cigarette comprising a generally cylindrical housing with a proximal mouth end and a distal end, and within the housing:

a vaporizer to produce vapor to be delivered to the mouth end;

a battery; and sensor circuitry to detect a user drawing on the mouth end and connect the battery to power the vaporizer to produce vapor, the vaporizer comprising:

a tube having inlet and outlet ends and extending longitudinally of the housing, supports at opposite ends of the tube for directing airflow into and out of the tube from the inlet to the outlet, a vaporizable liquid holder containing a vaporizable liquid extending around the tube, wicking fibers extending through side openings in the tube and configured to wick the vaporizable liquid from the vaporizable liquid holder into the tube, and an electrical heater coil in the tube configured to be powered by the battery to vaporize liquid on the wicking fibers in the tube, so that vapor is supplied along the tube to the outlet end when the user draws thereon, wherein the wicking fibers diverge from one another from the side openings and are spread over the outer surface of the tube so as to contact and receive the vaporizable liquid by capillary action from the matrix.

2. An electronic cigarette according to claim 1 wherein the spread wicking fibers lie spread over the outer surface of the tube in an arc which at its outermost spread subtends an angle (θ) at the central longitudinal axis of the tube of at least 30°.

3. An electronic cigarette according to claim 1 wherein the spread wicking fibers lie spread over the outer surface of the tube in an arc which at its outermost spread subtends an angle (θ) at the central longitudinal axis of the tube having a value in the range 40°-150°.

4. An electronic cigarette according to claim 1 wherein the spread wicking fibers extend towards the inlet end of the tube.

5. An electronic cigarette according to claim 1 wherein the spread wicking fibers extend towards the outlet end of the tube.

6. An electronic cigarette according to claim 1 wherein the wicking fibers emanating from at least one of the side openings are configured in first and second bundles which are spread in different directions along the tube.

7. An electronic cigarette according to claim 1 wherein the supports include a mouth end stopper that is push-fitted into the mouth end of the housing, the mouth end stopper including a mouthpiece spigot onto which the outlet end of the tube is received, and an outlet passageway extending through the spigot to provide an outlet for vapor from the tube.

8. An electronic cigarette according to claim 7 including a gap between the vaporizable liquid holder and the mouth end stopper.

9. An electronic cigarette according to claim 1 wherein the supports include an annular support member including a peripheral surface to engage with an interior of the housing, an inlet spigot on which the outlet end of the tube is mounted, and an inlet passageway extending through the inlet spigot to provide an inlet for air into the tube.

10. An electronic cigarette according to claim 8 wherein the annular support member includes a depending peripheral flange such that the vaporizable liquid holder is retained between the mouth end stopper and the flange.

11. An electronic cigarette according to claim 10 wherein ends of the wicking fibers are retained sandwiched between the tube and the vaporizable liquid holder between the spigot and the flange.

12. An electronic cigarette according to claim 9 including a washer between the annular support member and the battery.

13. An electronic cigarette according to claim 1 including an air inlet opening at the distal end of the housing.

14. An electronic cigarette according to claim 13 including an air feed passageway between the battery and the housing, extending from the air inlet opening to the inlet end of the tube.

15. An electronic cigarette according to claim 1 wherein the sensor circuitry is disposed between the battery and the distal end of the housing.

16. An electronic cigarette according to claim 1 including a light source powered by the battery under the control of the sensor circuitry to be illuminated in response to the user drawing on the mouth end.

17. An electronic cigarette according to claim 16 wherein the light source is disposed at the distal end of the housing.

18. An electronic cigarette according to claim 1 including an end cap push-fitted into the distal end of the housing.

19. An electronic cigarette according to claim 1 wherein the housing comprises a first part containing the battery releaseably coupled to a second part containing the vaporizer.

20. An electronic cigarette according to claim 1 wherein the vaporizable liquid holder comprises inner and outer sheets of overlying fibrous material with the outer sheet having a greater pore size than the inner sheet for wicking the liquid to the inner sheet by capillary action.

21. An electronic cigarette according to claim 1 including an atomization aperture in the tube configured to allow liquid to be drawn into the tube from the vaporizable liquid holder so as to be atomized by passage through the aperture when the user draws on the mouth end.

* * * * *